US006837159B2

(12) United States Patent
Elkotbi et al.

(10) Patent No.: US 6,837,159 B2
(45) Date of Patent: Jan. 4, 2005

(54) DEVICE AND METHOD FOR POSITIONING A CROSS CUT ON PRINTING MATERIAL AND WEB-FED PRESS HAVING THE DEVICE

(75) Inventors: Cherif Elkotbi, Compiegne (FR); Jean-Francois Robert, Creil (FR)

(73) Assignee: Goss International Montataire, S.A., Montataire Cedex (FR)

( * ) Notice: Subject to any disclaimer, the term of this patent is extended or adjusted under 35 U.S.C. 154(b) by 222 days.

(21) Appl. No.: 10/287,502

(22) Filed: Nov. 4, 2002

(65) Prior Publication Data

US 2003/0084765 A1 May 8, 2003

(30) Foreign Application Priority Data

Nov. 2, 2001 (DE) ..... 101 54 003

(51) Int. Cl.[7] ..... B41F 13/02; B41F 13/56; B41F 13/54

(52) U.S. Cl. ..... 101/219; 101/226; 101/227; 101/228; 101/485

(58) Field of Search ..... 101/219, 485, 101/226, 227, 228, 248; 83/29, 13, 367

(56) References Cited

U.S. PATENT DOCUMENTS

| | | | | | |
|---|---|---|---|---|---|
| 3,525,858 | A | * | 8/1970 | Thiede et al. | 358/1.5 |
| 3,806,012 | A | * | 4/1974 | Roch | 226/2 |
| 4,264,957 | A | * | 4/1981 | Pautzke | 700/125 |
| 4,366,753 | A | * | 1/1983 | Glanz et al. | 101/181 |
| 4,369,906 | A | * | 1/1983 | Isherwood | 226/42 |
| 5,056,431 | A | * | 10/1991 | Sainio | 101/219 |
| 5,123,316 | A | | 6/1992 | Niedermaier et al. | 83/29 |
| 5,301,578 | A | * | 4/1994 | Fromson | 83/42 |
| 5,438,926 | A | | 8/1995 | Hudyma et al. | 101/227 |
| 5,452,632 | A | * | 9/1995 | Durr et al. | 83/13 |
| 5,458,062 | A | | 10/1995 | Goldberg et al. | 101/485 |
| 5,485,386 | A | * | 1/1996 | Andreasson | 700/117 |
| 5,740,054 | A | * | 4/1998 | Durr et al. | 700/122 |
| 5,812,276 | A | * | 9/1998 | Jacobs | 358/302 |
| 5,899,128 | A | * | 5/1999 | Smithe et al. | 83/76 |
| 6,018,687 | A | * | 1/2000 | Tabor | 700/125 |
| 6,047,642 | A | * | 4/2000 | Hunkeler | 101/483 |
| 6,059,705 | A | * | 5/2000 | Ruthenberg et al. | 493/11 |
| 6,072,562 | A | * | 6/2000 | Frick | 355/55 |

(List continued on next page.)

FOREIGN PATENT DOCUMENTS

| | | |
|---|---|---|
| DD | 35 15 626 C2 | 10/1985 |
| DE | 42 34 308 C2 | 4/1994 |
| DE | 195 06 774 A1 | 8/1995 |
| DE | 199 10 835 C1 | 9/2000 |
| EP | 0 950 519 A1 | 10/1999 |
| JP | 05 042 668 A | 2/1993 |

*Primary Examiner*—Daniel J. Colilla
*Assistant Examiner*—Wasseem H. Hamdan
(74) *Attorney, Agent, or Firm*—Laurence A. Greenberg; Werner H. Stember; Ralph E. Locher

(57) ABSTRACT

A device for positioning a cross cut relative to printed images on at least one printing material web in a web-fed press having at least one printing unit, includes a cross cutter. Also included is a computing device for generating therein at least a first control signal for changing a phase angle of the printing unit and the cross cutter relative to one another. A path length variation device for changing a path length through which the printing material web runs between the printing unit and the cross cutter is also included. The computing device further serves for generating a second control signal for changing the path length and, by interaction of the change in the relative phase angle and the change in the path length, serves for adjusting the positioning of a cross cut on the printing material web. A web-fed printing press includes the cross-cut positioning device. A method for operating the device is also provided.

10 Claims, 4 Drawing Sheets

U.S. PATENT DOCUMENTS 6,092,466 A 7/2000 Koch et al. ..... 101/485
6,273,313 B1 * 8/2001 Noll et al. ..... 226/30
6,526,889 B2 * 3/2003 Tokiwa ..... 101/485
6,568,323 B2 * 5/2003 Tokiwa ..... 101/227
6,601,506 B2 * 8/2003 Dauer ..... 101/248
6,626,102 B2 * 9/2003 Tokiwa ..... 101/226
6,644,184 B1 * 11/2003 Hajek et al. ..... 101/177
6,691,620 B2 * 2/2004 Riepenhoff ..... 101/483
6,748,857 B2 * 6/2004 Seiler et al. ..... 101/226

* cited by examiner

DEVICE AND METHOD FOR POSITIONING A CROSS CUT ON PRINTING MATERIAL AND WEB-FED PRESS HAVING THE DEVICE

BACKGROUND OF THE INVENTION

Field of the Invention

The invention relates to a device for positioning a cross cut relative to printed images on at least one printing material web in a web-fed printing press having at least one printing unit. The device includes a cross cutter and a computing device for generating a control signal for changing a phase angle of the printing unit and of the cross cutter in relation to one another. The invention, furthermore, relates to a method for positioning a cross cut relative to printed images on at least one printing material web in a web-fed printing press having at least one printing unit, including a cross cutter. The invention also relates to a web-fed printing press having the device.

In web-fed printing presses, a class of presses which includes planographic printing presses, offset printing presses, web-processing printing presses, web-fed rotary printing presses or the like, having a downstream or assigned folder, serve for printing one or more printing material webs or partial webs of printing material webs in one or more colors and for processing them for forming signatures or copies. In this regard, the printing material web is moved along a web path through the web-fed printing press and into a folder downstream therefrom. At various positions along this web path, different operations, in particular printing on the material web, is performed with one color in a printing unit, and cutting up the material web is performed by a cutting device. Typically, operations of this type are performed cyclically or periodically repeated by operation elements, acting from cycle to cycle on different points or sections of the printing material web which are moving past. In order to ensure the same action on the printing material, it is necessary to synchronize the various cyclic movements which, in particular occur in printing units and the individual folder components, in relation to one another with respect to the relative phase angle thereof in the cycle. Expressed in other words, a first operation at a first position, which acts at a first instant of time on one point of the printing material web must be coordinated or correlated with a second operation at a second position which acts at a second instant of time on the same point on the printing material web. This is correspondingly true for a plurality of printing material webs or for partial webs belonging to a printing material web. In concrete terms, in web-fed printing presses there is, in particular, a necessity for positioning cross cuts, which separate sheet-like sections from the printing-material web, in relation to the printed images applied to the printing material web by one or more printing units, i.e., for performing cross cuts cyclically and in a manner correlated with the action of the printing units.

Prior art literature already discloses a large number of devices and methods for permitting a positioning of a cross cut relative to printed images on a printing material web in a web-fed printing press.

In European Patent-Application EP-0 950 519 A1, which corresponds to U.S. Pat. No. 6,092,466, a method is disclosed for the self-adjusting control of color and cut register in rotary presses with a plurality of webs. Instantaneous working points of the individual drives which transport the paper web, and the web path lengths between the drives serve for calculating a relative web expansion or extension value for each drive. By combining the web expansion values, correction variables are calculated, with which action is taken on the guide variables for the color register and the cut register. The cut position and the position of each printed color, respectively, are registered by measuring sensors. As a result of the (application of a correction variable, a change in the relative phase angle of the printing units (color register) and the cross cutters (cut register) can be carried out in a manner that the position (positioning) of the cross cut in relation to the printed image is corrected.

The drawback with a correction exclusively by register adjustment is that a relatively large adjustment travel may possibly be required.

U.S. Pat. No. 5,123,316, for example, discloses an apparatus and a method for the relative positioning of a cross cut in a rotary press on a number of partial webs lying above one another and belonging to a printing material. In order to position the individual partial webs relative to one another, the path length of each partial web which the relevant partial web covers can be lengthened and/or shortened independently of the path lengths of the other partial webs.

German Published, Non-prosecuted Patent Application DE 195 06 774 A1, which corresponds to U.S. Pat. No. 5,458,062, describes a method of controlling the relative positioning of cross cuts on a printing material, which includes detecting reference marks disposed on the printing material web, in particular independently of visible light, and controlling the relative position of cross cuts, in particular by changing the path length of the printing material web.

In practice, in the heretofore known apparatus for positioning by path length change, it has proven to be disadvantageous that the path length variation devices require a relatively large amount of space.

SUMMARY OF THE INVENTION

It is accordingly an object of the invention to provide an alternative device and method for positioning a cross cut relative to the position of printed images on a printing material web and a web-fed press having the device, which overcome the hereinafore-mentioned disadvantages of the heretofore-known devices and methods of this general type.

With the foregoing and other objects in view, there is provided, in accordance with the invention, a device for positioning a cross cut relative to printed images on at least one printing material web in a web-fed press having at least one printing unit. The device comprises a cross cutter. A computing device is provided for generating therein at least a first control signal for changing a phase angle of the printing unit and the cross cutter relative to one another. A path length variation device is used for changing a path length through which the printing material web runs between the printing unit and the cross cutter. The computing device also serves for generating a second control signal for changing the path length and serves, by interaction of the change in the relative phase angle and the change in the path length, for adjusting a positioning of a cross cut on the printing material web.

In accordance with another feature of the invention, the cross-cut positioning device further includes a longitudinal cutting device disposed downstream from the printing unit in travel direction of the printing material web past the printing unit and to the longitudinal cutting device. The longitudinal cutting device serves for cutting the printing material web into a plurality of partial webs. The path length variation device is provided for at least one of the partial webs. The computing device serves for generating the second control signal for changing the path length of the at least one partial web. The partial webs are combinable in mutually superimposed position at a gathering point located upstream of the cross cutter.

In accordance with a further feature of the invention, the cross-cut positioning device further includes a transmitter associated with the at least one printing unit for determining the phase angle thereof. A transmitter is associated with the cross cutter for determining the phase angle thereof. The computing device serves for generating the first control signal as a function of signals from the transmitters.

In accordance with an added feature of the invention, the cross-cut positioning device further includes a sensor associated with the path length of the length variation device of the at least one partial web for detecting one of at least part of a printed image and markings applied to the printing material. The second control signal associated with the at least one partial web is to be generated as a function of a signal from the sensor.

In accordance with an additional feature of the invention the cross-cut positioning device further includes a first sensor disposed upstream and a second sensor disposed downstream from the path length variation device of the at least one partial web for detecting one of at least part of a printed image and markings applied to the printing material. The second control signal associated with the at least one partial web is to be generated as a function of signals from the first and the second sensor.

In accordance with yet another feature of the invention, the web-fed press has individual drives for at least one of at least one printing unit, the cross cutter, and the path length variation device.

With the objects of the invention in view, there is also provided a web-fed printing press, comprising at least one printing unit, a folder disposed downstream therefrom, and at least one device for positioning a cross cut relative to printed images on at least one printing material web. The device includes a cross cutter for making a cross cut in the at least one material web. A computing device is provided for generating therein at least a first control signal for changing a relative phase angle of the printing unit and the cross cutter relative to one another. A path length variation device is used for changing a path length through which the printing material web runs between the printing unit and the cross cutter. The computing device also serves for generating a second control signal for changing the path length and serves, by interaction of the change in the relative phase angle and the change in the path length, for adjusting a positioning of a cross cut on the printing material web.

With the objects of the invention in view, there is additionally provided a method of positioning a cross cut relative to printed images on at least one printing material web in a web-fed press having at least one printing unit and a cross cutter. The method comprises the steps of determining a phase angle of the printing unit and the cross cutter relative to one another; changing the phase angle of the printing unit and the cross cutter relative to one another; changing a path length through which the printing material web runs between the printing unit and the cross cutter; and adjusting the positioning of a cross cut on the printing material by interaction of the changed relative phase angle and the changed path length.

In accordance with an additional mode, the method of the invention for positioning a cross cut further includes the additional steps of cutting up the printing material web into a plurality of partial webs. The partial webs are combined into a mutually superimposed form at a gathering point located upstream of the cross cutter. At least one path length through which a partial web of the printing material web runs between the printing unit and the cross cutter is changed. The position of the cross cut on the partial web is adjusted by interaction of the changed relative phase angle and the changed path length of the partial web.

In accordance with a concomitant mode, the method of the invention for positioning a cross cut further includes detecting at least one of at least part of the printed image and markings applied to the printing material on at least one partial web.

As mentioned above, the device according to the invention for positioning a cross cut relative to printed images on at least one printing material web in a web-fed press having at least one printing unit, includes a cross cutter and a computing device, wherein at least a first control signal for changing a relative phase angle of the printing unit and the cross cutter in relation to one another is to be generated. Such a device is distinguished by the fact that the path length through which the printing material web runs between the printing unit and the cross cutter can be changed by a path length variation device. A second control signal is to be generated by the computing device for changing the path length, so that the positioning of the cross cut on the printing material web is adjustable by an interaction between the change in the relative phase angle and the change in the path length. In other words, in order to achieve a synchronous, correlated or cooperative action of one or more printing units (color register) with the cross cutter (cut register), in the device according to the invention, both the phase angle of one or more printing units relative to the phase angle of the cross cutter, as well as the path length through which the printing material web passes between the position of the printing unit and the position of the cross cutter, can be varied.

In the device according to the invention, at least a first control signal for changing the phase angle and at least a second control signal for changing the path length are generated for this purpose in the computing device. In this regard, the two changes are selected so as to achieve an adjustment to a desired value of the cross cutter relative to the printed image. The two interacting or cooperating changes are therefore components of a requisite total change in order to achieve the synchronization of the periodic operations which are carried out on the printing material web at different positions on the web path, starting from an unsynchronized state. The computer device, assuming a knowledge of the maximum achievable adjustment travel for the phase angles of the printing unit and the cross cutter, as well as the maximum achievable adjustment travel for the path length variation device, and further having the knowledge of the then current phase angles and then current path lengths which, as is known to those skilled in the art, depends not only upon the geometric distance (path length per se) but also upon the web tension, the moisture content of the printing material web, the temperature and other parameters, makes it possible to determine a change in the relative phase angle of the printing unit and the cross cutter in relation to one another, and a change in the path lengths, forming a dimensional variable, which assesses the choice of the subdivision extremely, preferably minimally. For this purpose, a suitable algorithm, for example linear optimization, which assesses the choice of the changes, is implemented in the computing device. A typical dimensional variable is the required adjustment time of the changes to be performed, which is to be minimized under the given boundary conditions. Alternatively thereto, the required adjustment travel, both for the phase angle individually and for the path length individually, as well as for the two together, can be assessed and minimized as the dimensional variable. A change in the relative phase angle can be achieved both either by changing a phase angle of one of the printing units involved or of the cross cutter or by changing the phase angle of one of the printing units involved and the phase angle of the cross cutter.

The device according to the invention is not restricted to a press which processes only a single printing material web. After passing through the printing unit, the printing material web can pass through a longitudinal cutting device or slitter, wherein the printing material web is cut up into a number of partial webs. In connection with the invention, the term printing material web can therefore also be understood to be a partial web of a printing material web. A path length variation device can be provided for at least one of the partial webs, preferably for all of the respective partial webs. In the computing device, for at least one partial web, a second control signal, preferably a second control signal for each respective partial web, which is associated with or associated with a path length variation device, can be generated in order to change the path lengths thereof. The partial webs can be combined so as to lie above one another at a gathering point located upstream of the cross cutter.

Analogous with the situation described further above herein of dividing up the changes in phase angles and the changes in path lengths, an assessment of the changes can be made in the computing device.

A reduced adjustment time and/or an advantageously shorter adjustment travel, based upon the phase angle of the printing unit and of the cross cutter and based upon the path length variation, can advantageously be achieved by the device according to the invention.

In other words, the device according to the invention constitutes a system for positioning a cross cut made by a cross cutter relative to the position of printed images on a printing material web or a number of partial webs of a printing material web which can act simultaneously or equally on the path length variation devices which are involved, on the phase angle of the printing unit which are involved and on the phase angle of the cross cutter. Synchronization, correlation or coordination of the movements can advantageously be achieved in a short time and without any intervention by a pressman or press operator. The time advantage also results in the advantage of less wastage, because an adjustment is performed quickly.

The computing device should be provided with information about the maximum achievable adjustment travels for the phase angle of the involved printing units and cross cutters and for the maximum achievable adjustment travels for the involved path length variation devices and about the current phase angles and the current path lengths. On the one hand, this information can be provided by the machine controller. However, on the other hand it is advantageous if, in the device according to the invention, a transmitter is associated with at least one printing unit for determining the phase angle thereof, and a transmitter is associated with the cross cutter for determining the phase angle thereof. It is further advantageous if the first control signal is generated in the computing device as a function of the transmitter signals. Furthermore, at least one path length variation device of a partial web can be provided with a transmitter which generates a signal making it possible to determine the position of the path length variation device. This is preferably the case, if appropriate, for each of the path length variation devices. Furthermore, in the device according to the invention for the relative positioning of a cross cut, a sensor, a detector or a pickup is associated with at least one path length variation device of a partial web for detecting at least part of the printed image and/or markings applied to the printing material. The second control signal associated with the part web can be generated as a function of the signal from the sensor, detector or pickup. Each path length variation device of a partial web preferably has such sensors, detectors or pickups assigned thereto. The detector can be disposed to be located at a position along the web path upstream or downstream of the path length variation device. In an advantageous development of the device according to the invention, provision is made for a first sensor to be disposed upstream, and a second sensor to be disposed downstream of at least one path length variation device of a partial web, for detecting at least part of the printed image and/or markings applied to the printing material. The second control signal associated with the partial web is to be generated based upon the signals from the first and the second sensors. Each path length variation device of a partial web preferably has such first and second sensors assigned thereto. The markings can be configured so that they permit identification of the relevant partial web upon which they are lying. Expressed in another way, unambiguous markings on the partial webs permit assignment of the detectors to the partial webs. In particular, the markings can be printed on the partial webs. Markings can be applied either only to one side of the printing material web or to both sides of the printing material web, in particular by printing. The markings can preferably also be visible to the human eye. A system of optical sensors may therefore preferably be involved.

The relative phase angle of the printing unit and of the cross cutter in relation to one another is determined in the method according to the invention for the relative positioning of a cross cut with respect to printed images on at least one printing material web in a web-fed press having at least one printing unit and a cross cutter. The relative phase angle of the printing unit and of the cross cutter in relation to one another is changed. The method of the invention is distinguished by the fact that the path length through which the printing material web passes between the printing unit and the cross cutter is changed so that, in interaction or cooperation between the changed relative phase angle and the changed path length, the position of the cross cut on the printing material web is adjusted. The relative phase angle can be achieved either by absolute changes in the individual phase angles or by an absolute change in only one of the two phase angles.

In the method according to the invention for the relative positioning of a cross cut, it is further possible for the printing material web to be cut up into a number of partial webs and for the partial webs to be combined, in a form superimposed above one another, at a gathering point located upstream from the cross cutter. At least one path length through which a partial web of the printing material web passes between the printing unit and the cross cutter is changed so that, in interaction or cooperation between the changed relative phase angle and the changed path length of the partial web, the position of the cross cut on the combined partial webs is adjusted. All the path lengths of the number of partial webs are preferably changed.

In an advantageous embodiment of the method, at least part of the printed image and/or markings applied to the printing material on the printing material web and/or at least one partial web, preferably all of the partial webs, are detected.

The device according to the invention for the relative positioning of a cross cut can be used in a web-fed press with a downstream folder in order to benefit from the advantages thereof. In this regard, the web-fed press can use one printing unit, for example, for printing two pages (including printed images) per revolution or four pages (including printed images) per revolution of the printing form cylinder. A web-fed press wherein the device according to the invention is implemented or embodied preferably has individual drives for at least one printing unit and/or for the cross cutter and/or for at least one path length variation device. The individual drives can, for example, be motors or servomotors which can be synchronized with one another electronically. A web-fed press according to the invention having a downstream folder, whether the web-fed press is for processing one or more printing material webs or for processing one or more partial webs, is consequently distinguished by a device according to the invention. Furthermore, the folder can also have a longitudinal folding device either with or without a folding former. The folder may either be pinless or include cylinders whereon the signatures separated from the printing material web or the partial webs can be picked up by perforating pins.

It should also be noted that typical printing materials which are processed in web-fed presses of the general type referred to herein include, amongst others, paper of varying grammage, quality and color, pasteboard, material fabrics and films of polymer materials or foils of metallic materials.

Other features which are considered as characteristic for the invention are set forth in the appended claims.

Although the invention is illustrated and described herein as embodied in a device and a method for positioning a cross cut on printing material and a web-fed press having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
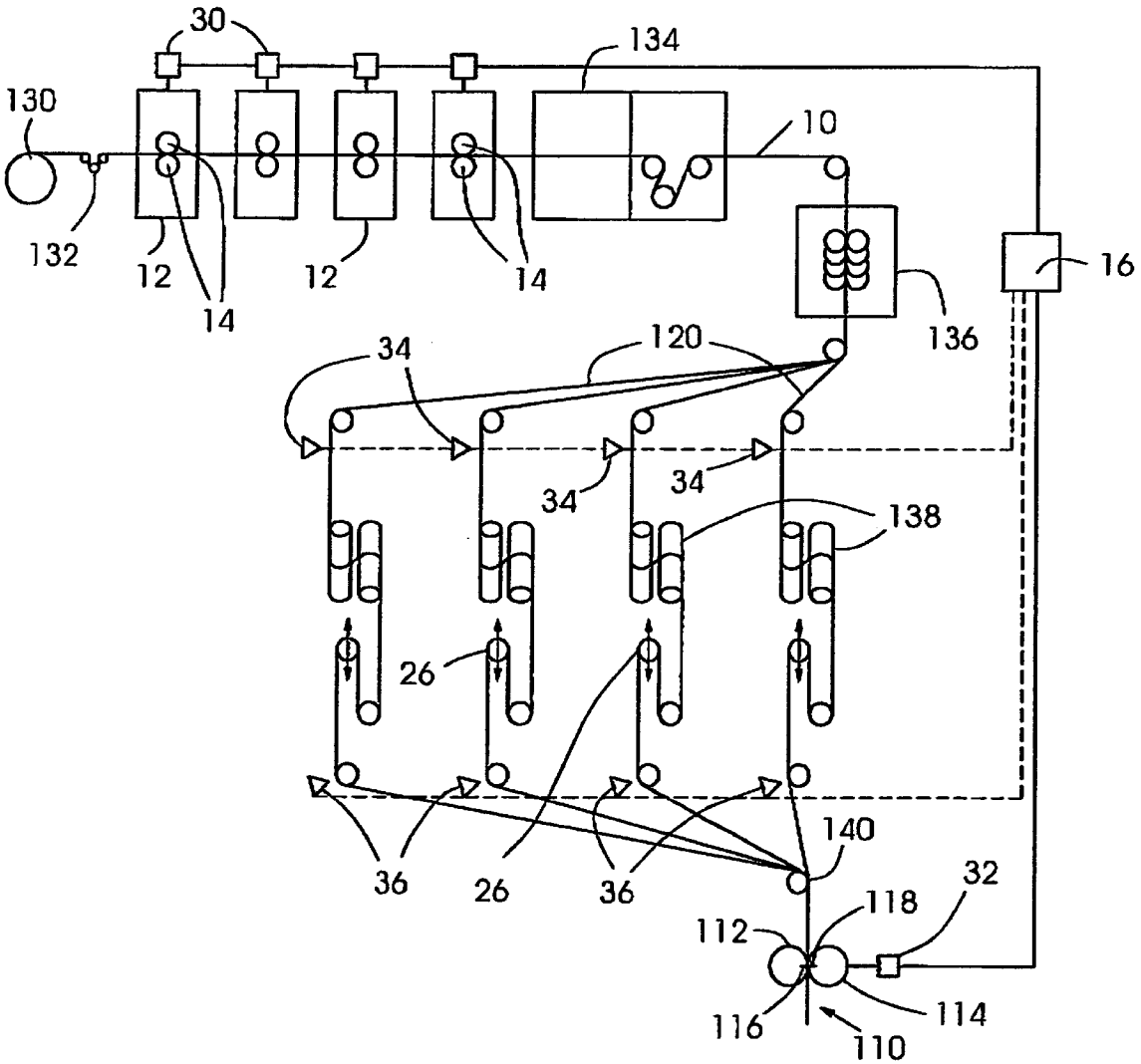
FIG. 1 is a diagrammatic and schematic view of the course of a web path through a web-fed press with the device according to the invention.

Referring now to the figures of the drawings in detail and first particularly, to FIG. 1 thereof, there is shown therein schematically and diagrammatically the course of the web path through an embodiment of a web-fed press having the device according to the invention. Starting from an unwinding device 130 (reel changer), a printing material web 10 runs over a feeding device 132 (swinging roll) through a number of printing units 12, four printing units 12 by way of example here, between respective cylinders 14. The printing material web 10 passes on the web path thereof through a dryer 134, also with a cooling device, into a longitudinal cutting device or web slitter 136, wherein the printing material web is cut up or divided into partial webs 120, four partial webs 120 by way of example in this case. Each of the partial webs 120 passes over a respective deflection device 138 assigned thereto so that the individual partial webs 120 can be combined lying above one another at a gathering point 140. In each web path of a partial web, a path length variation device 26 is provided. The combined partial webs 120 then pass into the cross cutter 110 which, in the embodiment shown herein, includes a first cutting cylinder 112 having a cutting knife 116, and a second cutting cylinder 114 having a support element 118 or being formed with a groove. In the illustrated embodiment, the path length variation device 26 has a movable deflection roller for the partial web. The path length 18 can be changed (as shown in FIGS. 2A and 2B) by changing the position of the respective deflection roller, as indicated by the double-headed arrow associated therewith.

The embodiment of the web-fed press having a positioning device according to the invention is provided with transmitters 30 associated with each printing unit 12 and a transmitter 32 associated with the cross cutter 110. The transmitters 30, 32 are connected to a computing device 16 and can transmit information to the computing device 16. A first series of first sensors 34 is disposed upstream of the path length variation devices 26 in each web path of the respective partial webs 120, and a second series of second sensors 36 is disposed downstream of the path length variation devices 26 in each web path of the respective partial webs 120, but upstream of the gathering point 140 in sections of the web paths close to the entry to the folder, upstream of the cross cutter. The sensors 34, 36 permit the detection of markings 24 or parts of or complete printed images on the printing material web 10 (see also FIG. 3). Information about when a specific marking 24 has passed the positions of specific sensors 34, 36 on the web path of a partial web 120 is transmitted to the computing device 16. From this information, the computing device 16 is able to determine, amongst other things, the differences between the path lengths traced on the web paths of the partial webs 120 and the offset of the markings 24 in relation to one another, as the latter will lie above one another at the gathering point 140 in the absence of a path length change.

Figure 2A:
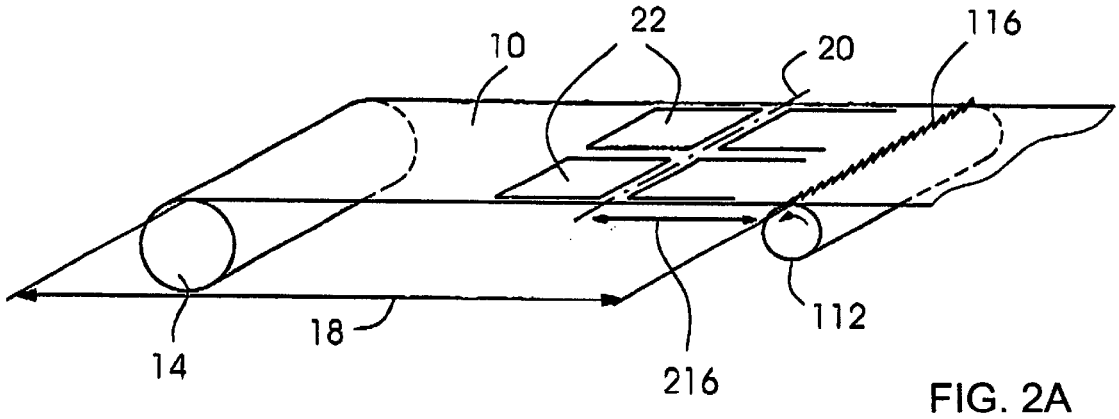
FIG. 2A is a fragmentary, diagrammatic, perspective view of a printing unit and a cross cutter depicting a change in the relative phase angle therebetween.
Figure 2B:
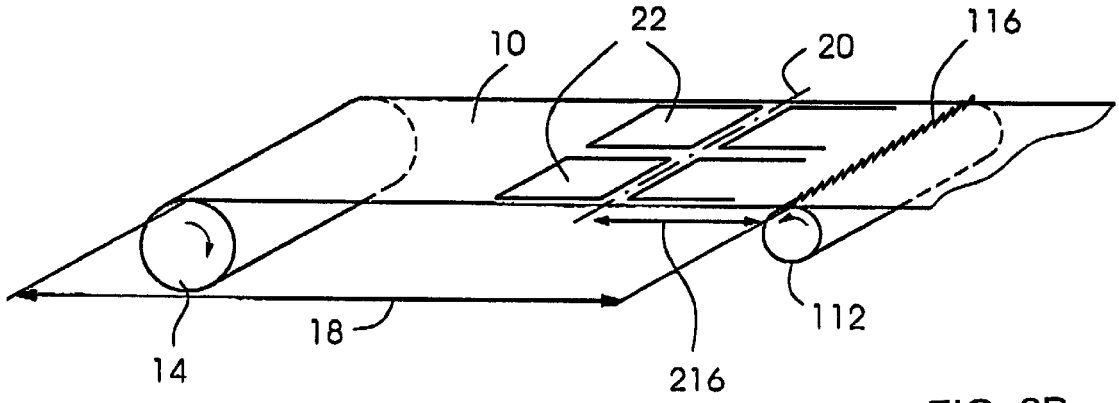
FIG. 2B is a view similar to that of FIG. 2A depicting an alternative change in the relative phase angle between the printing unit and the cross cutter.

FIG. 2A is a fragmentary, diagrammatic representation of a change in the relative phase angle between a printing unit and a cross cutter, and FIG. 2B is a diagrammatic representation of an alternative change in the relative phase angle with advantageous shortening of the adjustment time. These figures serve for explaining the changes in the relative phase angles in the device and method according to the invention. Shown on a printing material web 10 are printed images 22 and a desired position 20 of the cross cut, as well as a cylinder 14 in a printing unit 12, the phase angle (angular position) of which can be determined by a transmitter signal and changed by a drive. A first cutting cylinder 112 has a cutting knife 116, the phase angle (angular position) of which can be determined by a transmitter signal and can be changed by a drive (the transmitters and drives are not shown in FIGS. 2A and 2B).

The transmitters can be disposed directly on the shaft of the cylinder 14 or the first cutting cylinder 112 or on parts of the drive of the cylinder 14 and of the first cutting cylinder 112 which have an operative kinematic connection.

The information from these transmitters is passed on to the computing device 16. The path length 18 is the effective distance which, as is known, depends not only upon the geometric distance (path length per se) but also upon the web tension, the moisture content of the printing material web 10, the temperature and other parameters, between the first position, at which the cylinder 14 acts, and the second position, at which the first cutting cylinder 112 acts with the cutting knife 116. The points or locations thereof on the printing material web 10 pass one after another.

In FIG. 2A, the change in the relative phase angle due to changing the phase angle of the first cutting cylinder 112 is represented by the curved arrow. Shown herein by way of example is a situation wherein the change in the phase angle is carried out by a rotation in a mathematically positive direction (the counterclockwise direction), which leads to a displacement of the action of the cutting knife 116 from specific points on the printing material web 10 to points on the printing material web 10, which are disposed downstream from the aforementioned specific points. For example, the phase angle change can be chosen so that the first offset 216 is overcome, and the cutting knife severs the printing material web at the desired position 20. In a corresponding manner, a rotation in the negative mathematical direction (the clockwise direction) leads to a displacement of the action of specific points on the printing material web 10 to points disposed upstream therefrom on the printing material web 10. In an analogous manner, it is also possible to make a change in the phase angle of the cylinder 14. To change the relative phase angle by changing the absolute phase angle of only one of the operation elements involved, a specific first time interval is required.

In part 2B, the change in the relative phase angle as a result of simultaneously changing the phase angle of the cylinder 14 and the phase angle of the first cutting cylinder 112 is represented by the associated curved arrows. The change in the relative phase angle is performed by mutually opposite rotations, i.e., mathematically positive for the cylinder 14 and mathematically negative for the first cutting cylinder 112, and mathematically negative for the cylinder 14 and mathematically positive for the first cutting cylinder 112, respectively. For changing the relative phase angle in order to compensate for a first offset 216 by changing the absolute phase angles of both of the operation elements which are involved, a specific second time interval is required, which is shorter than the first time interval determined, wherein a phase angle change can be made, as shown in FIG. 2A. At the same time, the adjustment paths to be covered are shorter.

Due to the explanations relating to FIGS. 2A and 2B, it should become clear that due to the change in the relative phase angles in a web-fed press having a printing unit and a cross cutter, which are operated with the same cycle length (period), for a single printing material web, it is also possible to dispense with a path length variation device.

Figure 3A:
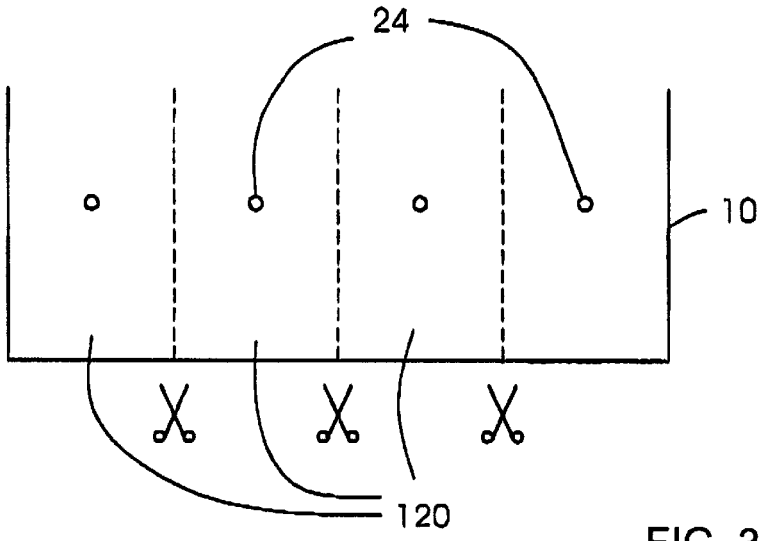
FIG. 3A is a fragmentary, diagrammatic, plan view of a printing material web having markings associated with partial webs thereof.
Figure 3B:
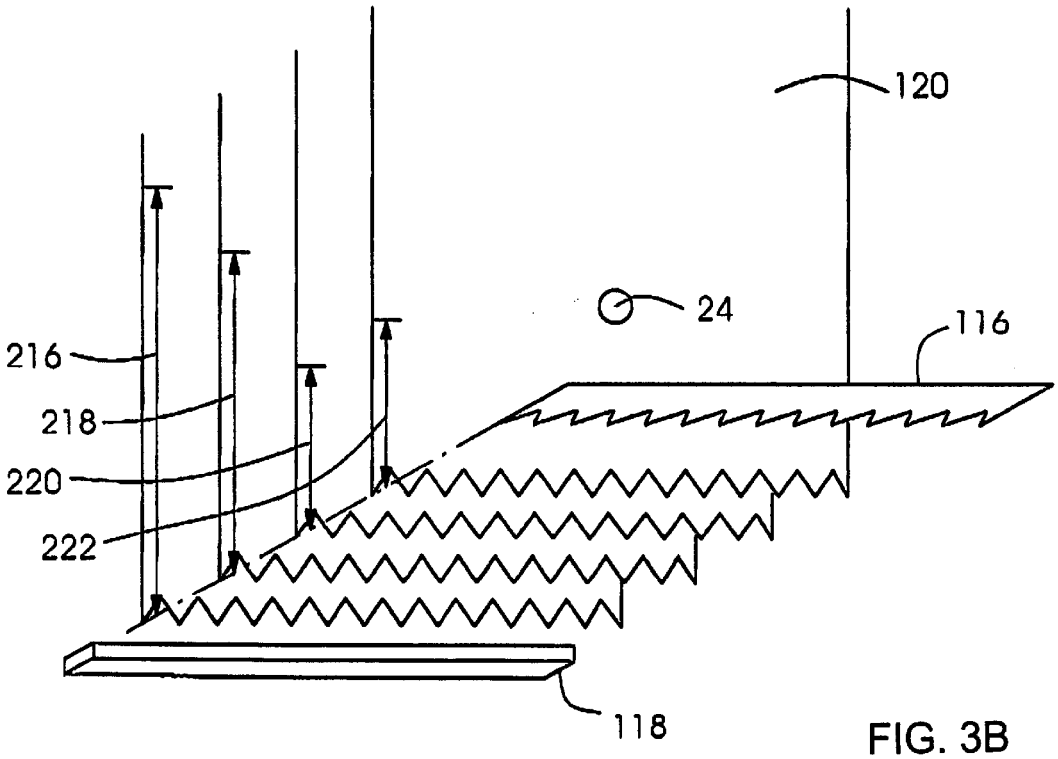
FIG. 3B is a fragmentary, diagrammatic, plan view of the individual partial webs of FIG. 3A, shown enlarged and disposed on top of one another with respective offsets with the aid of the different positions of the markings.

FIG. 3A relates diagrammatically to an assignment of markings to partial webs of the printing material web, and FIG. 3B to an offset of individual partial webs which are laid above one another with the aid of the different positions of the markings. FIG. 3A shows a printing material web 10 which is divided or slit longitudinally into four partial webs 120 (indicated symbolically by scissors), shown here by way of example. Markings 24 can be seen on the partial webs 120, for example printed thereon, which have a common position along the web path of the printing material web (points on the printing material web on a line perpendicular to the web path are equivalent to one another in this regard). Each partial web 120 can be identified preferably with the aid of the marking 24; the marking 24 is thus preferably unambiguous or indisputable. The markings 24 are disposed on the printing material web in such a way that, after the division of the web 10 into the partial webs 120 has been performed, each partial web 120 bears a marking 24. FIG. 3B shows the situation of the combined or mutually superimposed partial webs 120 upstream of the cross cutter 110, which is indicated here by the cutting knife 116 and the support element 118. Because of the different path lengths of the web paths which the partial webs 120 take in order to come into the mutually superimposed-form thereof, each of the path webs 120 has a generally different offset in relation to a reference position, here the position of the cross cutter 110. Shown as an example here for the four partial webs 120 are a first offset 216, a second offset 218, a third offset 220 and a fourth offset 222 for the position of the markings 24. The information about this offset is made available to the computing device 16. This can be done by the sensors 34, 36, as already explained herein in greater detail with regard to FIG. 1.

Figure 4:
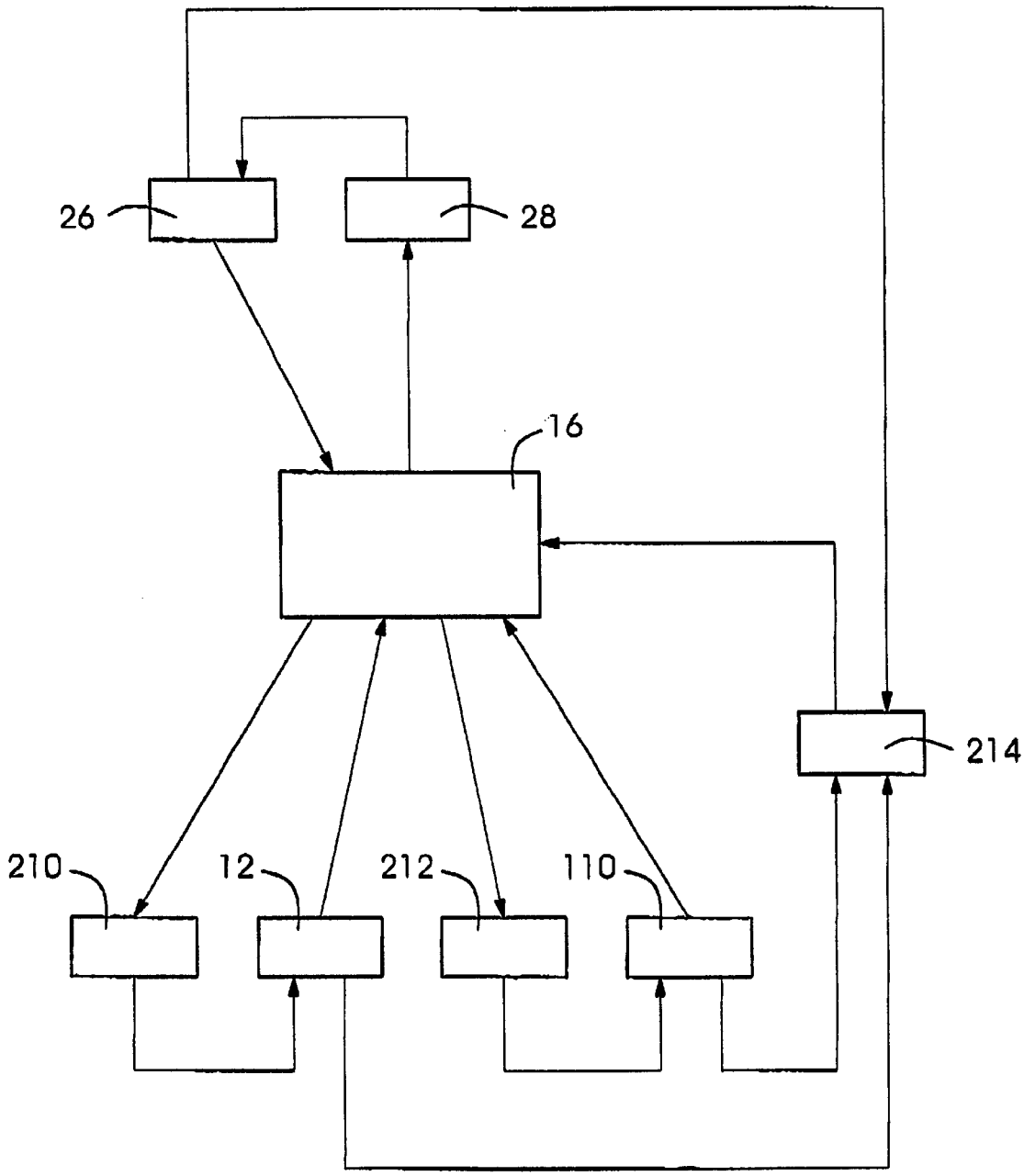
FIG. 4 is a block diagram illustrating the information flow between a computing device, drives and a transmitter system in accordance with the invention.

In FIG. 4 there is shown a block diagram of the information flow between a computing device, drives (with the respectively assigned printing units, the assigned cross cutter and the assigned path length variation devices, respectively) and a transmitter system. In this connection, by the drive there is understood to be both the actual mechanical kinematic drive and the control thereof. The computing device 16 is capable of transmitting control signals to the drive 210 of the printing units 12 or the drives of the printing units, the drive 28 of the path length variation device 26 or the drives of the path length variation devices, and the drive 212 of the cross cutter 110. Control signals here can have the form of pulses, data packets, voltage levels of various values or the like. The control signal can be digital or analog, and can be sent in a single time interval or in a number of time intervals. A first control signal from the computing device 16 for changing the relative phase angle of the printing unit 12 and the cross cutter 110 can be intended, as has already been described in detail hereinabove, both only for the drive 210 or only for the drive 212 as well as for both drives 210 and 212, simultaneously (FIG. 2). For the case of the simultaneous change in both the absolute phase angle of the printing unit 12 and the absolute phase angle of the cross cutter 110, a plurality of control signals can also be sent separately to the drive 210 of the printing unit 12 and to the drive 212 of the cross cutter 110. A second control signal and a number of second control signals, respectively, which among themselves can contain different information for different settings, is and are, respectively, transmitted to the drive 28 of the path length variation device 26 and the drives of the path length variation devices, respectively. The drives 28, 210, 212 act upon the operation elements assigned thereto, which include a path length variation device 26, a printing unit 14 and a cross cutter 110, in accordance with the information for changing the then current state in the control signals.

The transmitter system 214 serves for picking up and generating information regarding the then current state of the operation elements involved (print units 12 and cross cutter 110) and the then current path length (path length variation device 26): transmitters are provided for detecting the phase angle of the printing unit 12 or the phase angles of the printing units, a transmitter is provided for detecting the phase angle of the cross cutter 110, and sensors are provided for detecting markings on the printing material web and on the partial webs, respectively, so that information regarding the then current path length (over the physical distance resulting from influencing parameters, beyond the effective distance between two involved operation elements) is obtained for the computing device 16.

The computing device 16 should provide the then current position and the extreme possible positions (minimal and maximal) of each path length variation device 26, in order for the computing device 16 to be able to determine the change paths available for the path length variation devices 26 to as far as the extreme positions thereof. The computing device 16 may have a memory device, wherein a setting found for the path length variation devices 26 and the phase angles of the printing units 12 and the cost cutter 110 can be stored and from which a setting can be called up again as required for a print job with similar parameters. By individual, unambiguous markings 24 or an unambiguous association or assignment of sensors 34, 36, which is known to the computing device 16, it is possible to identify the individual partial webs 120, so that an automatic adjustment of the path length variation devices 26 and/or the relative phase angles of the printing units 14 and of the cross cutter 110 is possible based upon the result from the computing device 16.

To those skilled in the art, it is believed to be clear that the computing device 16 can also be provided with information regarding the phase angle and the associated or assigned path length, respectively, of further operation elements, such as the unwinding device 130, the feeding device 132, the deflection devices 138, drive rolls and the like, in an advantageous further development of the device according to the invention. This information may, amongst others, be relevant for the determination of the path length 18, which can certainly also change during the operation of the press.

As an alternative to the embodiment illustrated in FIG. 4, provision can also be made, starting from the computing device 16, for control signals to be sent to part of the machine controller or to a necessary or desirable central machine controller which may be provided. The machine controller is capable of exchanging data with the drives of the individual operation elements of the web-fed press with a folder disposed downstream therefrom.

By the positioning device according to the invention, as has become clear from the embodiment illustrated in the figures, the overall space required for path length variation devices in the web path of the printing material web and the partial webs, respectively, is reduced considerably, because due to the computing device, a division of the changes into phase angle changes and path length changes is performed, taking into account boundary values or required conditions. In the presented positioning device according to the invention, the path length variation device has a maximum length change of one quarter of the printed image, a value which corresponds to only half the value of conventional path length variation devices without phase angle change. This statement applies irrespective of the number of pages which are printed per revolution in the web-fed press.

With the positioning device according to the invention or by using the method according to the invention, a time gain can be achieved for presetting the web-fed press while reducing wastage. The adjustment of the phase angle of the partial webs in relation to one another can be carried out quickly and without any intervention by a pressman or machine operator. The start-up time of the web-fed press can be shortened, and printing material can be saved. Furthermore, automatic register presetting for the correlation of cross cut and involved printing units is made possible. The division determined by the computing device of the simultaneous and correlated path length changes and phase angle changes to be performed permits synchronization of the web-fed press with the downstream or associated folder in a short time and with short adjustment paths.

We claim:

1. A device for positioning a cross cut relative to printed images on at least one printing material web in a web-fed press having at least one printing unit, the device comprising:

a cross cutter;

a computing device for generating at least a first control signal for changing a phase angle of the printing unit and of the cross cutter relative to one another; and a path length variation device for changing a path length through which the printing material web runs between the printing unit and said cross cutter;

said computing device also generating a second control signal for changing said path length and adjusting a positioning of the cross cut on the printing material web by interaction of the change in said relative phase angle and the change in said path length.

2. The cross-cut positioning device according to claim 1, further comprising a longitudinal cutting device disposed downstream from the printing unit in travel direction of the printing material web past the printing unit and to said longitudinal cutting device, said longitudinal cutting device cutting the printing material web into a plurality of partial webs, said path length variation device being provided for at least one of the partial webs, said computing device generating said second control signal for changing the path length of the at least one partial web, the partial webs to be combined in mutually superimposed position at a gathering point located upstream of said cross cutter.

3. The cross-cut positioning device according to claim 2, further comprising a sensor associated with the path length of said length variation device of the at least one partial web for detecting one of at least part of a printed image and markings applied to the printing material, the second control signal associated with the at least one partial web to be generated as a function of a signal from said sensor.

4. The cross-cut positioning device according to claim 2, further comprising a first sensor disposed upstream and a second sensor disposed downstream from said path length variation device of the at least one partial web for detecting one of at least part of a printed image and markings applied to the printing material, the second control signal associated with the at least one partial web to be generated as a function of signals from said first and said second sensors.

5. The cross-cut positioning device according to claim 1, further comprising:

a transmitter associated with the at least one printing unit for determining the phase angle thereof; and a transmitter associated with said cross cutter for determining the phase angle thereof, said computing device generating said first control signal as a function of signals from said transmitters.

6. The cross-cut positioning device according to claim 1, wherein the web-fed press has individual drives for at least one of at least one printing unit, said cross cutter, and said path length variation device.

7. A web-fed printing press, comprising at least one printing unit, a folder disposed downstream of said at least one printing unit, and at least one device for positioning a cross cut relative to printed images on at least one printing material web, the at least one device for positioning including:

a cross cutter for making a cross cut in the at least one material web;

a computing device for generating at least a first control signal for changing a phase angle of the printing unit and the cross cutter relative to one another; and a path length variation device for changing a path length through which the printing material web runs between the printing unit and the cross cutter;

said computing device also generating a second control signal for changing said path length and adjusting a positioning of the cross cut on the printing material web by interaction of the change in said relative phase angle and the change in said path length.

8. A method of positioning a cross cut relative to printed images on at least one printing material web in a web-fed press having at least one printing unit and a cross cutter, the method which comprises the steps of:

determining a phase angle of the printing unit and the cross cutter relative to one another;

changing the phase angle of the printing unit and the cross cutter relative to one another;

changing a path length through which the printing material web runs between the printing unit and the cross cutter; and adjusting the position of the cross cut on the printing material by interaction of the changed relative phase angle and the changed path length.

9. The method for positioning a cross cut according to claim 8, which further comprises the additional steps of:

cutting up the printing material web into a plurality of partial webs;

combining the partial webs into a mutually superimposed form at a gathering point located upstream of the cross cutter;

changing at least one path length through which a partial web of the printing material web runs between the printing unit and the cross cutter; and adjusting the position of the cross cut on the partial web by interaction of the changed relative phase angle and the changed path length of the partial web.

10. The method for positioning a cross cut according to claim 9, which further comprises detecting at least one of at least part of the printed image and markings applied to the printing material on at least one partial web.

* * * * *